United States Patent [19]

Wallis et al.

[11] Patent Number: 4,788,745

[45] Date of Patent: Dec. 6, 1988

[54] APPARATUS AND METHOD FOR ATTACHMENT OF A HANDLE TO SCREEN DOORS AND THE LIKE

[76] Inventors: James R. Wallis; Christina M. Trowbridge, both of 11002 N. 81st Ave., both of Peoria, Ariz. 85345

[21] Appl. No.: 59,500

[22] Filed: Jun. 8, 1987

[51] Int. Cl.[4] ..... E05B 1/00

[52] U.S. Cl. ..... 16/114 R; 16/124; 16/DIG. 19; 16/DIG. 24; 49/460

[58] Field of Search ..... 16/114 R, 124, DIG. 19, 16/DIG. 24, DIG. 32, DIG. 41; 49/460; 403/17; 160/371, 379, 380

[56] References Cited

U.S. PATENT DOCUMENTS 3,605,854 9/1971 Majeske ..... 160/371

3,838,539 10/1974 Gronowicz ..... 160/371

*Primary Examiner*—Nicholas P. Godici

*Assistant Examiner*—Edward A. Brown

*Attorney, Agent, or Firm*—William W. Holloway

[57] ABSTRACT

A handle for attachment to screen doors and the like is comprised of two identical components, each component being positioned on opposite sides of the screen. Each of the two components has apertures formed in an extended component section for attachment to the frame of a screen door by a nut and bolt arrangement. Each component has a body section extending over the screen. The body section of each component has at least one body section passage. A threaded insert attached in one body section passage permits a screw passing through the body section passage of the screw of the opposite components to couple the two component body sections together. Each body section is structured to permit a user to engage the component manually without difficulty. In the preferred embodiment, the component body sections are fabricated of sufficient size to be easily visible by even casual observation.

9 Claims, 1 Drawing Sheet

APPARATUS AND METHOD FOR ATTACHMENT OF A HANDLE TO SCREEN DOORS AND THE LIKE

BACKGROUND OF THE INVENTION

1. Field of the Invention

This invention relates generally to screen doors, screen windows and the like and more particularly to an apparatus for manually exerting force for opening and closing these building structures.

2. Description of the Related Art

The screen doors and windows used in current building construction frequently have a small latch mechanism that detachably couples the door or window to the frame containing the screen door or window, the frame thereby attaching the screen door or window to the building structure. The latch mechanism frequently extends parallel to the screen and has a small protecting structure that can act as a handle. The protecting structure provides the manual engagement mechanism for opening or closing the screen door or window. The latch mechanism and the protecting structure are relatively small and consequently are relatively inconspicuous. Because of the lack of visibility of the handle protecting structure, the presence of the screen is not always observed resulting in inadvertent contact with, and damage to, the screen. Furthermore, during normal usage of the screen door or window, the movement on the frame tracks becomes more and more difficult and there is a tendency for the hand to slip from the protecting structure and cause damage to the screen.

A need has herefor been felt for apparatus and method that permits more comfortable manual engagement of the screen door or window and which presents greater visibility with respect to the presence of the screen.

FEATURES OF THE INVENTION

It is an object of the present invention to provide an improved screen door or screen window unit.

It is a feature of the present invention to provide a handle that can be attached to a screen door or window.

It is yet another feature of the present invention to provide a handle for screen doors and windows and the like comprised of two substantially identical sections.

It is a still further feature of the present invention to provide a handle for a screen door or window or the like that provides a highly visible indicator of the position of the structure to which the handle is attached.

SUMMARY OF THE INVENTION

The aforementioned and other features are accomplished, according to the present invention, by providing a screen door or window handle comprised of two components. The two components are substantially identical and are located on corresponding opposite sides of the screen. Each component is attached to the frame holding the screen. In addition, passages in the body sections of the components permit the components to be attached in a region removed from the frame. The relatively large size of the components and the structure thereof permits relatively easy manual gripping for movement of the screen and frame assembly, distributes any force applied to the screen to a wide area and provides a relatively visible indicator of the presence of the screen.

These and other features of the present invention will be understood upon reading of the following description along with the drawings.

BRIEF DESCRIPTION OF THE DRAWINGS

FIG. 3 is a cross-section view of the component along line III of FIG. 2, while

DETAILED DESCRIPTION OF THE PREFERRED EMBODIMENT

1. Detailed Description of the Figures

Figure 1:
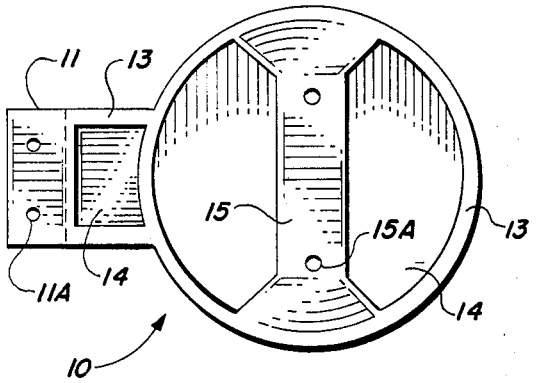
FIG. 1 is a top view of a handle component forming one half of the handle unit of the present invention.

Referring now to FIG. 1, a top view of the component 10 comprising one of two substantially identical sections of the handle of the present invention is shown. The component 10 has two principal sections, a rectangular section and a circular section. The rectangular section includes an attachment section 11 and a coupling section. The attachment section has two passages 11A formed therethrough. The coupling section includes a base plate 14 and a rim 13. The circular section has a base plate 14 (that is a continuation of the base plate of the coupling section) and a rim 13. A ridge 15 extends above the remainder of the circular section of the component 10. The ridge 15 has two passages 15A formed therein. The ridge 15, in conjunction with recessed base plate 14 areas, provide a structure for convenient manual engagement of the fixture.

Figure 2:
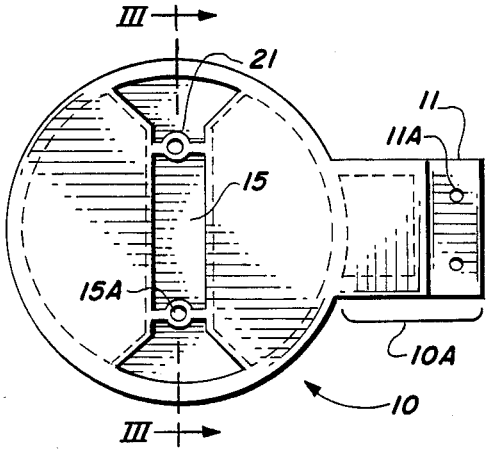
FIG. 2 is a bottom view of the component forming one half of the handle of the present invention.

Referring to FIG. 2, a bottom view of the components forming the handle of the present invention is shown. Ridge 15 extends above the base plate 14 of component 10 in the preferred embodiment. Structure 21 is provided to strengthen the region of the passages 15A. The rectangular section of component 10 is shown as 10A in FIG. 2.

Figure 3:
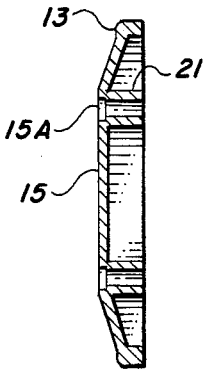
Figure 3A:
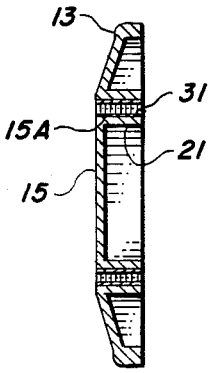
FIG. 3A illustrates the same view with the addition of the passage inserts to provide the mechanism for coupling the components of the handle unit.

Referring next to FIG. 3, the cross-sectional view of the component along the III line of FIG. 2 is shown. The ridge 15 and the rim 13 are indicated along with the structure 21 for strengthening the region of passages 15A. Comparing FIG. 3 with Fig. 3A, in FIG. 3A inserts 31 are coupled into passages 15A. The inserts include a threaded portion for engaging the threads of a screw. A handle of the present invention includes one component without the inserts and a second component with the inserts.

Figure 4:
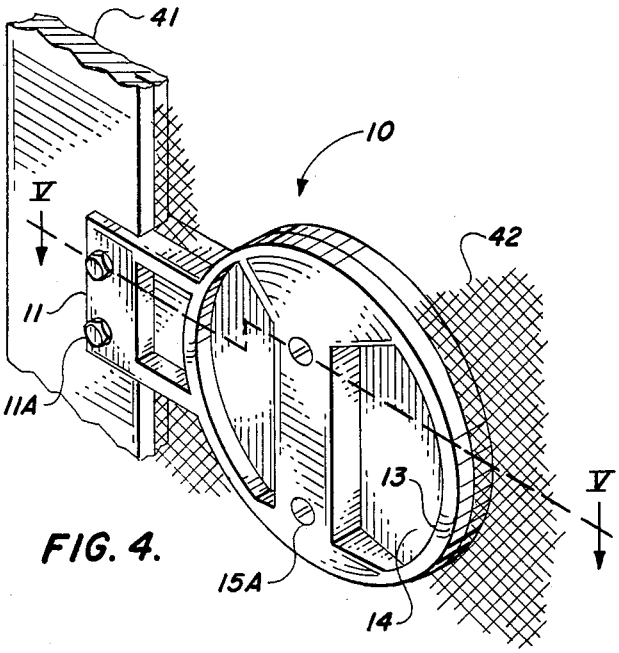
FIG. 4 is a perspective view of the screen door or window handle according to the present invention.

Referring next to FIG. 4, a perspective view of the handle of the present invention in the operational position is shown. The attachment section 11 is positioned with respect to screen frame 41 such that bolts pass through passages 11A in the two components 10 and through passages in the frame 41. Nuts are attached to the bolts and secure the two components of the handle to the frame. Screws are inserted in the passages 15A of a component without inserts coupled therein and are threaded into the inserts 31 in the component 10 of the handle to which inserts have been coupled. The screw is adapted to force the two components 10 against the screen 42 which is positioned between the two components. The base plate 14 engages a large area of the screen and therefore reduces the occurrence of screen tearing. The coupling of the two components also provides additional structural integrity for the handle. It will be clear that the passages 11A and 15A must be appropriately positioned so that the corresponding passages will be aligned for the insertion of screws therethrough.

Figure 5:
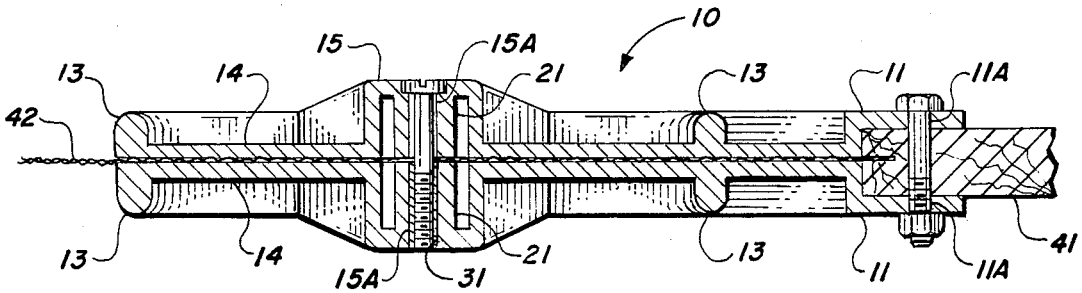
FIG. 5 is a cross-sectional view of the handle along line V of FIG. 4 of the handle according to the present invention.

Referring next to FIG. 5, as cross-sectional view of the screen door or screen window handle along the V line of FIG. 4 is shown. The frame 41 engages the screen 42 and the handle is disposed on either side of the screen. A bolt passes through passages 11A in both components 10 and through a passage in the frame 41. A nut is used to secure the two components 10 to the frame 41. The upper component 10 does not include inserts in passages 15A and has a screw inserted therethrough. The lower component 10 has the insert 31 coupled within passage 15A and the screw threads engage the threads of the insert 31. In this manner, the two components 10 are coupled together independently of the coupling to frame 41. The screw(s) in apertures 15A provide additional structural support for the handle and engage the screen over a relatively large area. The rims 13 provide each component with additional structural integrity. Structure 21 provides additional strength in the vicinity of the passages 15A.

2. Operation of the Preferred Embodiment

Screen doors and windows commonly used in the construction industry are distinguished by relatively small, difficult to grip effectively and difficult to see, handle and latch structures. When the screen structure is newly installed, relatively little force is required to move the screen structure. With the use, more force is required to change the position of the screen door or window. With this change, the handle structure provided by the manufacturer, satisfactory during the initial period, becomes only marginally functional. Similarly, the handle structure provided by the manufacturer is relatively inconspicuous and accidents involving collisons with a closed screen door are relatively common.

The present invention provides a handle that, after attachment to the frame containing the screen, has sufficient structural integrity to permit movement of screen doors requiring a relatively large amount of force. In addition, the size of the handle can provide an important visual clue concerning the presence of the screen door and this effect can be enhanced by appropriate coloring of the components. Because the two component portions of the handle, which in the preferred embodiment are fabricated of a plastic material, are substantially identical and can be formed in a common mold, the cost of the handle is relatively inexpensive to manufacture. The screws coupling the two components are generally fairly small so that, if the handle is removed, the screen will be relatively undamaged.

According to another embodiment, one of the two passages 15A can be fabricated to include a structure similar to the structure with the insert. Thus, when the two components are fastened together, a screw can pass through a passage in each component and be in position to couple to the other component. The arrangement has the advantage that the components are fabricated identically and do not require additional processing (such as the insertion of inserts in the passages) before assembly.

The foregoing description is included to illustrate the operation of the preferred embodiment and is not meant to limit the scope of the invention. The scope of the invention is to be limited only by the following claims. From the foregoing description, many variations will be apparent to those skilled in the art that would yet be encompassed by the spirit and scope of the invention.

What is claimed is:

1. An attachable handle for attaching to a screen door or window, said attachable handle comprising:

a first and a second component, each of said components including;

an attachment portion for coupling to a frame of said screen door, and a handle portion extending from said attachment portion and having a base plate for contacting said screen when said attachment handle is operably attached to said screen door or window, said handle portion having a vertical ridge suitable for being manually gripped when said attachable handle is operably attached, said handle portion having a surrounding ridge generally enclosing said vertical ridge, said first and second components extending out from said frame and over opposite sides of a screen of said screen door or window when said attachable handle is operably attached to said screen door or window, wherein said handle portion has apertures fabricated therein, and at least one insert, said first and said second components having substantially identical structures with at least one aperture fabricated therethrough, said inserts are positioned in said second component apertures, said apertures located so that a screw passing though a first component aperture engages an insert positioned in a second component aperture, said first component base plate and said second component base plate securing an area of said screen therebetween when said screw is fastened to said insert.

2. The attachable handle for a screen door or window of claim 1 wherein said surrounding ridge is structured to reduce flexing of said attachable handle resulting from an externally applied force, said surrounding ridge also being structured to reduce inadvertent contact with said screen during manual gripping of said attachable latch.

3. The attachable handle for a screen door or window of claim 2 wherein said attachable handle is brightly decorated to enhance visibility.

4. The method of providing an attachable handle for manually moving a screen door or window comprising the steps of:

fabricating a first and a second component with substantially identical structures, said first and said second components each having an attachment portion and a handle portion, each said handle portion having apertures passing therethrough, each handle portion having a gripping ridge structure for gripping said handle and at least one strengthening ridge structure on an exterior side of each handle portion;

positioning inserts in said second component apertures;

attaching said first and said second component attachment portions to opposite sides of a frame of said screen door or window, said first and said second component handle portions including a base plate having a generally flat surface contacting an overlapping area of a screen of said screen door or window on an interior side of each handle portion; and securing said overlapping area of said screen by said first and said second component by passing a screw through at least one aperture of said first component and fastening said screw to an associated insert in said second component apertures.

5. The method of providing a screen door or window handle of claim 4 wherein said fabricating step further includes the step of fabricating a strengthening ridge to reduce flexing of said handle.

6. An attachable and detachable handle for moving screen doors and the like having a frame comprising:

a first component including an attachment portion and a handle portion, said attachment portion having at least one passage permitting a fastener to pass therethrough and attach said handle to said frame, said handle portion having a flat interior surface for contacting a screen of said screen door and having extended structures on an exterior surface of said handle, said extended structures facilitating manual application of force to said handle and increasing the structural integrity of said handle, said handle portions having apertures positioned at selected locations fabricated therein;

a second component substantially identical to said first component to be coupled to an opposite side of the frame, wherein said interior handle portion surfaces of said component are separated only by an area of said screen when said first and said second components are attached to said frame; and at least one insert positioned in a second component handle portion aperture, said insert adapted to engage a fastening element inserted through a corresponding first component handle portion aperture, wherein said fastening element securing said area of said screen by said first and second component handle portion interior surfaces.

7. The screen door handle of claim 6 wherein said fastener element is a screw and said insert has a threaded structure.

8. The screen door handle of claim 7 wherein said extended structure reduces bending of said handle when coupled to said screen door.

9. The screen door handle of claim 6 wherein said handle portion is generally circular.

* * * * *